United States Patent [19]

Morell

[11] Patent Number: 4,646,401

[45] Date of Patent: Mar. 3, 1987

[54] DEVICE FOR TIGHTENING A FLEXIBLE CONNECTING ELEMENT

[75] Inventor: Joseph Morell, Annecy, France

[73] Assignee: Salomon S.A., Annecy, France

[21] Appl. No.: 744,368

[22] Filed: Jun. 13, 1985

[51] Int. Cl.[4] ..... B68D 68/08

[52] U.S. Cl. ..... 24/68 SK; 24/585; 24/70 SK; 24/71 SK

[58] Field of Search ..... 24/68 SK–71 SK, 24/68 A, 68 R, 70 R, 585, 584; 36/50

[56] References Cited

U.S. PATENT DOCUMENTS

| | | | |
|---|---|---|---|
| 3,662,435 | 5/1972 | Allsop | 24/70 SK |
| 4,229,862 | 10/1980 | Kubelka | 24/68 SK |
| 4,387,517 | 6/1983 | Annoui | 24/71 SK X |
| 4,395,801 | 8/1983 | Gabrielli | 24/70 SK |
| 4,449,274 | 5/1984 | Balbinot | 24/68 SK X |
| 4,451,956 | 6/1984 | Kawahara | 24/69 ST X |

FOREIGN PATENT DOCUMENTS

| | | | |
|---|---|---|---|
| 1282367 | 12/1961 | France | 24/585 |
| 1358328 | 3/1964 | France | 24/585 |

*Primary Examiner*—Peter A. Aschenbrenner

*Attorney, Agent, or Firm*—Pollock, Vande Sande & Priddy

[57] ABSTRACT

Device for tightening a strap (1) for the upper of a ski boot. The strap has driving teeth (4) on one side and retaining teeth (5) on the other side. The retaining teeth engage with a fixed tooth (6) forming an abutment carried by an anchoring piece (2), while the driving teeth are engaged by a rib (9) on a control member (3), which rib exerts a longitudinal thrust on one of the driving teeth during pivoting movement of the control member (3) in a first, strap tightening direction. The control member (3) also comprises a projection (10) for denotching the retaining teeth.

8 Claims, 5 Drawing Figures

DEVICE FOR TIGHTENING A FLEXIBLE CONNECTING ELEMENT

FIELD OF THE INVENTION

The present invention relates to a device for tightening a flexible connecting element, such as a strap, applicable, for example, to the tightening of a ski boot.

BACKGROUND OF THE INVENTION

Various devices for tightening straps notched on one of their faces are known in the art. These usually comprise a pivoting tensioning element itself having, on a portion of its periphery, a tooth cooperating with the teeth of the strap. Such a device is disclosed, e.g., in French Pat. No. 2,180,250. This known device assures increasing tensioning of the strap by pivoting of the movable element in one direction, and it comprises auxiliary means for retention of the strap when the latter has reached a tension corresponding to the desired degree of tightening. Such prior art devices, however, usually have rather complex structures and require inconvenient operations for eliminating the tightening tension on the strap when the latter is to be freed.

SUMMARY OF THE INVENTION

The present invention seeks to overcome these disadvantages by means of particularly simple device which assures, by actuation of a single movable element, either increasing tension on the strap or its liberation.

For this purpose, the tightening device of the present invention has, on one of its faces, a series of drive teeth in the shape of saw teeth, each cooperating with a control member mounted for pivoting movement on an anchoring piece carrying means for maintaining the strap to be tigthened. On its other face, the strap has a series of retaining teeth having the same pitch as the driving teeth and cooperating with a fixed tooth forming an abutment carried by the anchoring piece. The pivoting control member comprises, with regard to the driving teeth, a thrust element engaging with the driving teeth and exerting a longitudinal thrust on one of these during pivoting movement of the control member in a first, strap tigthening direction. The pivoting control member also comprises, with regard to the retaining teeth, a denotching stud enabling the retaining teeth to be separated from the fixed tooth during pivoting movement of the control member in a second, untightening direction opposite to the first direction, in order to assure separation and liberation of the strap from the anchoring piece.

BRIEF DESCRIPTION OF THE DRAWINGS

In order that the invention may be more clearly understood, reference will now be made to the accompanying drawings, wherein an embodiment of the invention is shown for purposes of illustration, and wherein.

DETAILED DESCRIPTION

Figure 1:
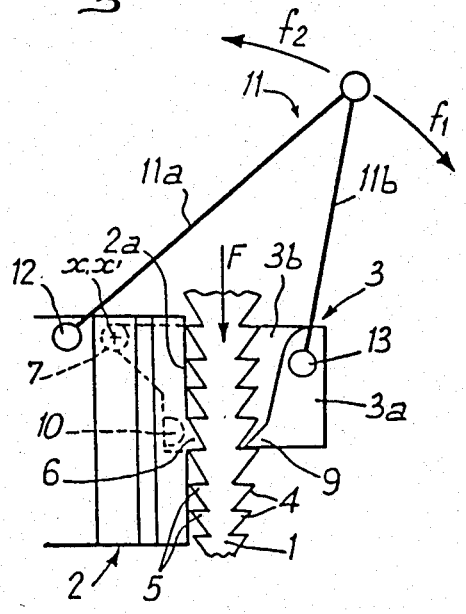
FIG. 1 is a schematic elevation of a strap tightening device according to the invention, showing the strap in immobilized position.

The device according to the invention is intended to assure progressive tightening of a flexible connecting element 1, such as a strap, making it possible to bring to bear, on the part to be tightened, longitudinal traction of a strength F variable as a function of the desired degree of tightness. The device uses a strap 1, notched on its two faces, which is immobilized on an anchor piece 2 and which is subjected to the action of a movable control member 3. Strap 1 has, on one of its faces, a series of drive teeth 4, in the shape of saw teeth, and on its opposite face, another series of retaining teeth 5, also in the shape of saw teeth, of the same pitch as the drive teeth. The two sets of teeth 4, 5 may be symmetrical with respect to a longitudinal median plane, as shown in the drawings, or they may be longitudinally offset with respect to one another.

Anchoring piece 2, which is preferably in the form of a substantially parallelepipedic block, comprises a front face **2*a* along which slides and is retained strap 1. On this front face 2*a* is formed a horizontal tooth or rib 6 which constitutes an abutment for retaining teeth 5 of strap 1 and which is oriented in the opposite direction from the latter. This fixed tooth 6 preferably has the cross sectional shape of a right triangle substantially corresponding to those of retaining teeth 5. As may be seen in FIG. 1, tooth 6 is engaged, while strap 1 is immobilized, in the space separating two successive retaining teeth 5. To assure the retaining function of strap 1, the small side of the right triangle section of fixed tooth 6 should be facing downwardly, i.e., in the sense of the direction according to which traction is effected on the strap which assures tightening, it being understood that retaining teeth 5, like drive teeth 4 of strap 1**, each have the small side of their right triangular section facing upwardly.

Movable control member 3 may be right-angled, as shown in the drawings, and it thus comprises a first wing **3*a* parallel to front face 2*a* of anchoring piece 2, and a perpendicular second wing 3*b* parallel to lateral face 2*b*** of said anchoring piece, at a certain distance from the latter.

According to a variant, control member 3 may have the shape of a U or of a cover lid for anchor piece 2.

Control member 3 is mounted for pivoting movement about a horizontal axis xx' materialized by at least one stud 7 integral with wing(s) **3*b* of member 3 and engaging in a horizontal hole 8 in lateral face 2*b* of anchoring piece 2. Member 3, which can thus pivot about axis xx', comprises a thrust element 9 cooperating with drive teeth 4 of strap 1. Element 9 is in the form of a rib in the shape of an acute dihedral angle engageable in the space delimited between two successive drive teeth 4. In rest position, thrust rib 9 is located at the same level as fixed tooth 6, as shown in FIG. 1, if the two series of teeth 4, 5 are symmetrical with respect to a longitudinal plane. However, this arrangement is not critical, and rib 9 could be longitudinally offset with respect to fixed tooth 6 if the two series of teeth 4, 5** are longitudinally offset with respect to each other.

Pivoting control member 3 also carries a denotching stud 10 projecting from the inner face of wing **3*b* of member 3 and substantially at the level of thrust rib 9, this stud 10 being located opposite a marginal region of retaining teeth 5**.

Control member 3 is also fast with a lever 11 having two arms 11*a* and 11*b*, arm 11*a* being articulated on anchoring piece 2 about a horizontal axis 12, while arm 11*b* is articulated on control member 3 about an axis 13.

Figure 3:
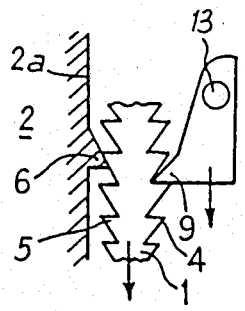
FIGS. 3 and 4 are schematic views illustrating displacement of the strap from one tooth step during a tightening operation.
Figure 4:
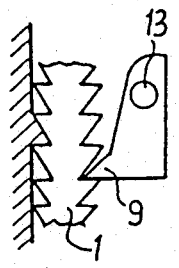
Figure 2:
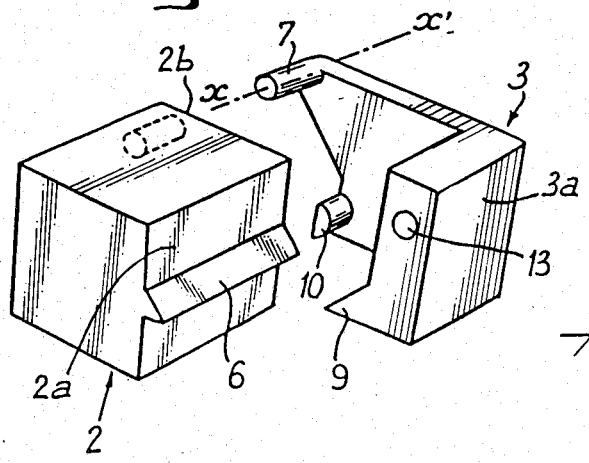
FIG. 2 is an exploded perspective view of the anchoring piece and the pivoting control member of the device.

The operation of the device is as follows:

With strap 1 maintained in any position corresponding to a given degree of tightness, as shown in FIG. 1, the control member assembly 3 is pivoted in a clockwise direction to increase tightness, as indicated by arrow $f_1$, by actuating lever 11. This pivoting movement of member 3 translates into a downward thrust by rib 9, which is in contact with a transverse small side of the lower drive tooth 4. As a result, strap 1 is moved downwardly and the opposite upper retaining tooth 5, which is in contact with fixed tooth 6, slides along the upper inclined side of the latter. As a result, strap 1 is moved downwardly, being progressively separated from front face 2*a* of anchoring piece 2, as shown in FIG. 3. When the downward movement corresponds to one notch, fixed tooth 6 can again engage in a space between two retaining teeth 5, and strap 1 is brought into contact with front face 2*a* of anchoring piece 2, thrust rib 9 still being in contact with the same drive tooth 4, as shown in FIG. 4. If member 3 is then liberated, it can return to rest position, e.g., under the effect of an elastic mechanism, causing member 3 to pivot counterclockwise. During such pivoting, rib 9 moves upwardly and returns to a position opposite teeth 6.

The described tightening operation is repeated as often as necessary until the desired degree of tightening is attained.

Figure 5:
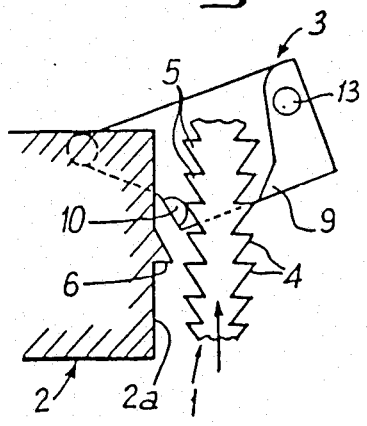
FIG. 5 is a schematic view illustrating denotching or liberation of the strap.

If the strap is to be freed, member 3 is pivoted counterclockwise from its rest position shown in FIG. 1, as illustrated by arrow $f_2$, by actuating lever 11. During this movement, stud 10 comes into contact with a retaining tooth 5 of strap 1 and pushes the latter away from front face 2*a*, as shown in FIG. 5. Retaining teeth 5 being then spaced from fixed tooth 6, strap 1 is entirely free and tightening does not take place.

The device according to the invention can be used for tightening a strap surrounding the rod of a ski boot.

What is claimed is:

1. Device for tightening a flexible connecting element (1) having a plurality of faces, a series of sawtooth shaped first teeth (4) being provided on one of said faces, said device comprising a control member (3) for effecting the movement of said connecting element to selectively tightened positions, said control member being pivotally mounted on an anchoring piece (2) carrying means for retaining said connecting element in such positions, said connecting element having, on its other face, a series of retaining teeth (5) of the same pitch as said first teeth and cooperating with a fixed tooth (6) forming an abutment carried by said anchoring piece (2), said pivotable control member (3) comprising a projection (9) for engaging said first teeth (4) and exerting a longitudinal thrust on one of them during its pivoting movement in a first direction, said pivotable control member (3) further comprising a denotching stud (10) causing said retaining teeth (5) to be disengaged from said fixed tooth (6) during pivoting movement of said control member (3) in a second direction opposite said first direction, so as to assure separation and release of said connecting element (1) from said anchoring piece (2).

2. Device according to claim 1, wherein said series of teeth (4, 5) are symmetrical with respect to a longitudinal median plane bisecting said connecting element.

3. Device according to claim 1, wherein said series of teeth (4, 5) are offset from one another with respect to a longitudinal plane bisecting said connecting element.

4. Device according to claim 1, wherein said anchoring piece (2) has a front face (2*a*) along which said connecting element slides and is retained and on which is formed said fixed tooth (6) having a shape complementary to that of said retaining teeth (5).

5. Device according to claim 4, wherein said control member (3) comprises a first wing (3*a*) parallel to said front face (2*a*) of said anchoring piece, and at least one second wing (3*b* ) perpendicular to said first wing (3*a*) and parallel to and spaced from a lateral face (2*b*) of said anchoring piece (2), said projection (9) being respectively located at substantially the same vertical level on the lower portion of said first wing (3*a*) and on the lower portion of an inner face of said second wing (3*b*).

6. Device according to claim 5, wherein said projection (9) comprises a rib in the shape of an acute dihedral angle engageable in a space delimited between two successive first teeth (4).

7. Device according to claim 1, wherein said control member (3) is pivoted by a lever (3) having first and second arms (11*a*, 11*b*), said first arm (11*a*) being articulated on said anchoring piece (2) about a horizontal axis (12), and said second arm (11*b*) being articulated on said control member (3) about an axis (13).

8. Device according to claim 1, wherein said connecting element is a strap for a ski boot.

* * * * *